US010582745B2

(12) United States Patent
Kadar

(10) Patent No.: US 10,582,745 B2
(45) Date of Patent: Mar. 10, 2020

(54) RING ASSEMBLY

(71) Applicant: Michal Kadar LLC, New York, NY (US)

(72) Inventor: Michal Kadar, New York, NY (US)

( * ) Notice: Subject to any disclaimer, the term of this patent is extended or adjusted under 35 U.S.C. 154(b) by 0 days.

(21) Appl. No.: 15/580,589

(22) PCT Filed: Jun. 30, 2016

(86) PCT No.: PCT/US2016/040352
§ 371 (c)(1),
(2) Date: Dec. 7, 2017

(87) PCT Pub. No.: WO2017/007674
PCT Pub. Date: Jan. 12, 2017

(65) Prior Publication Data

US 2018/0177265 A1 Jun. 28, 2018

Related U.S. Application Data

(60) Provisional application No. 62/188,512, filed on Jul. 3, 2015.

(51) Int. Cl.
*A44C 9/00* (2006.01)

(52) U.S. Cl.
CPC ..... *A44C 9/0015* (2013.01); *A44C 9/0023* (2013.01); *A44C 9/0092* (2013.01)

(58) Field of Classification Search
CPC ... A44C 9/0038; A44C 9/0046; A44C 9/0053; A44C 9/0061; A44C 9/0092;
(Continued)

(56) References Cited

U.S. PATENT DOCUMENTS 1,596,642 A 8/1926 Weber
3,307,375 A 3/1967 Estrin
(Continued)

FOREIGN PATENT DOCUMENTS

CH 701593 A1 * 2/2011 ..... A44C 9/0092
CH 701593 A1 2/2011
(Continued)

OTHER PUBLICATIONS

The Coolest Engagement Ring Your Fiancee Never Knew She Wanted (Pursuitist) Jul. 12, Jan. 13, 2016. Retrieved from the Internet on Aug. 29, 2016. URL: <https://web.archive.Org/web/20160712125628/http://pursuitist.com/the-coolest-engagement-ring-your-fiancee-never-knew-she-wanted.
(Continued)

*Primary Examiner* — Jack W Lavinder
(74) *Attorney, Agent, or Firm* — Tarter Krinsky & Drogin LLP

(57) ABSTRACT

Exemplary embodiments of a ring and ring assembly are provided. In one embodiment, a ring assembly is provided having an inner ring, an outer ring having a groove within an inner portion of the outer ring that fits the inner ring, and a mechanism provided on the outer ring allowing the outer ring to be opened to place the inner ring within the outer ring. The outer ring can have an opening through which a jewel on the inner ring can project when the outer ring is closed. The outer ring can have a design that surrounds the jewel on the inner ring.

13 Claims, 5 Drawing Sheets

(58) Field of Classification Search
CPC ... A44C 9/0007; A44C 9/0015; A44C 9/0023; A44C 9/003
USPC ..... 63/15.1
See application file for complete search history.

(56) References Cited

U.S. PATENT DOCUMENTS

| | | | | |
|---|---|---|---|---|
| 5,253,490 | A | 10/1993 | Doganay | |
| 5,419,158 | A | 5/1995 | Sandberg | |
| 5,596,887 | A | 1/1997 | Bergagnini | |
| 5,727,399 | A | 3/1998 | Bergagnini | |
| 7,398,657 | B2 * | 7/2008 | Cleofas | A44C 9/0023 63/15 |
| 2006/0218969 | A1 | 10/2006 | Cleofas | |
| 2014/0130546 | A1 | 5/2014 | Bisserier | |
| 2014/0260426 | A1 | 9/2014 | Singh et al. | |
| 2016/0218969 | A1 | 7/2016 | Shaw et al. | |
| 2017/0055647 | A1 * | 3/2017 | Samanta | A44C 17/0208 |

FOREIGN PATENT DOCUMENTS

| | | | | | |
|---|---|---|---|---|---|
| CN | 101495008 | A | | 7/2009 | |
| FR | 1001782 | A | * | 2/1952 | A44C 9/00 |
| FR | 1001782 | A | | 2/1952 | |
| FR | 1562229 | A | | 4/1969 | |
| WO | 2006099215 | A2 | | 9/2006 | |

OTHER PUBLICATIONS

Chinese Office Action dated Mar. 5, 2019.
European Search Report dated Dec. 4, 2018.

* cited by examiner

RING ASSEMBLY

FIELD OF THE DISCLOSURE

The present disclosure relates to exemplary embodiments of a ring assembly, and more particularly, to exemplary embodiments of an outer ring assembly for holding an inner ring.

BACKGROUND INFORMATION

People like to wear different rings for different looks, but need to purchase separate rings for each look. As such, there exists a need for a ring that can provide different looks and provide for interchangeability in various configurations.

SUMMARY OF EXEMPLARY EMBODIMENTS OF THE PRESENT DISCLOSURE

At least some of the above described problems can be addressed by exemplary embodiments of the apparatuses and methods according to the present disclosure. For example, using such exemplary embodiments, it is possible to provide a ring assembly, comprising an inner ring, an outer ring comprising a groove within an inner portion of the outer ring configured to fit the inner ring, and a mechanism provided on the outer ring allowing the outer ring to be opened to place the inner ring within the outer ring. The mechanism can comprise a hinge mechanism. In some exemplary embodiments, the groove is not visible when the outer ring is in a closed configuration.

The outer ring can comprise a first side and a second side, wherein the mechanism holds the first side and the second side together and allows the outer ring to be in an open and closed configuration, and the groove can comprise a first groove on the first side and a second groove on the second side that fits the inner ring within the outer ring.

The ring assembly can further comprise an opening provided on a top portion of the outer ring. The ring assembly can further comprise a design on a top portion of the inner ring that projects out of the opening when the inner ring is placed within the outer ring and the outer ring is in a closed configuration. The design can be a jewel. The ring assembly can further comprise a design on a top portion of the outer ring that surrounds the design on the top portion of the inner ring when the outer ring is in a closed configuration. The inner and outer rings cam be of a circular shape.

In some exemplary embodiments, an outer ring can be provided, comprising a first side having a first groove on an inner portion of the first side, a second side having a second groove on an inner portion of the second side, and a hinge mechanism joining the first side and the second side that allows the first and second sides to be in an open configuration where the first and second grooves are visible and a closed configuration where the first and second grooves are not visible, wherein the grooves are adjacent each other in the closed configuration and configured to allow a ring to be held within the grooves. The outer ring can further comprise an opening provided on a top portion of the first side and the second side when the first and second sides are in a closed configuration. The outer ring can further comprise a design on a top portion of the first and second sides that surrounds the opening when the first and second sides are in a closed configuration. The hinge can be provided on a bottom portion of the first and second sides.

These and other objects, features and advantages of the present disclosure will become apparent upon reading the following detailed description of embodiments of the present disclosure, when taken in conjunction with the appended claims. It should be understood that the detailed description and specific examples, while indicating the preferred or exemplary embodiments of the disclosure, are intended for purposes of illustration only and are not intended to limit the scope of the disclosure.

BRIEF DESCRIPTION OF THE DRAWINGS

The foregoing and other exemplary objects of the present disclosure will be apparent upon consideration of the following detailed description, taken in conjunction with the accompanying exemplary drawings and claims, in which like reference characters refer to like parts throughout, and in which:

Figure 1:
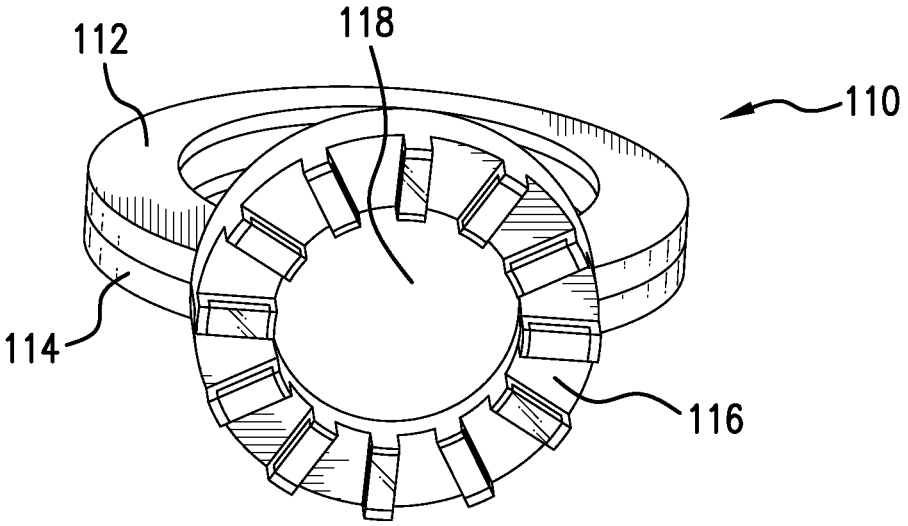
FIG. 1 is an illustration of an outer ring in a closed configuration according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

Exemplary embodiments of the apparatuses and methods of the present disclosure will now be described with reference to the figures. The exemplary embodiments of the present disclosure can provide for various designs of a ring assembly. The following description of the various embodiments is merely exemplary in nature and is in no way intended to limit the scope of the disclosure, its application, or uses.

FIG. 1 is an illustration of an outer ring 110 in a closed configuration according to an exemplary embodiment of the present disclosure. In some exemplary embodiments, the outer ring 110 can have a first side 112 and a second side 114. The first side 112 and second side 114 can be circular, oval or other shapes, and are not limited to any particular shape or thickness. The outer ring 110 can have a top portion 116 provided on a top of the first side 112 and the second side 114, as explained further below. The top portion 116 can have a design and/or ornaments provided on a surface of the top portion 116. In some exemplary embodiments, the top portion 116 can have an opening 118 in the middle of it.

Figure 2:
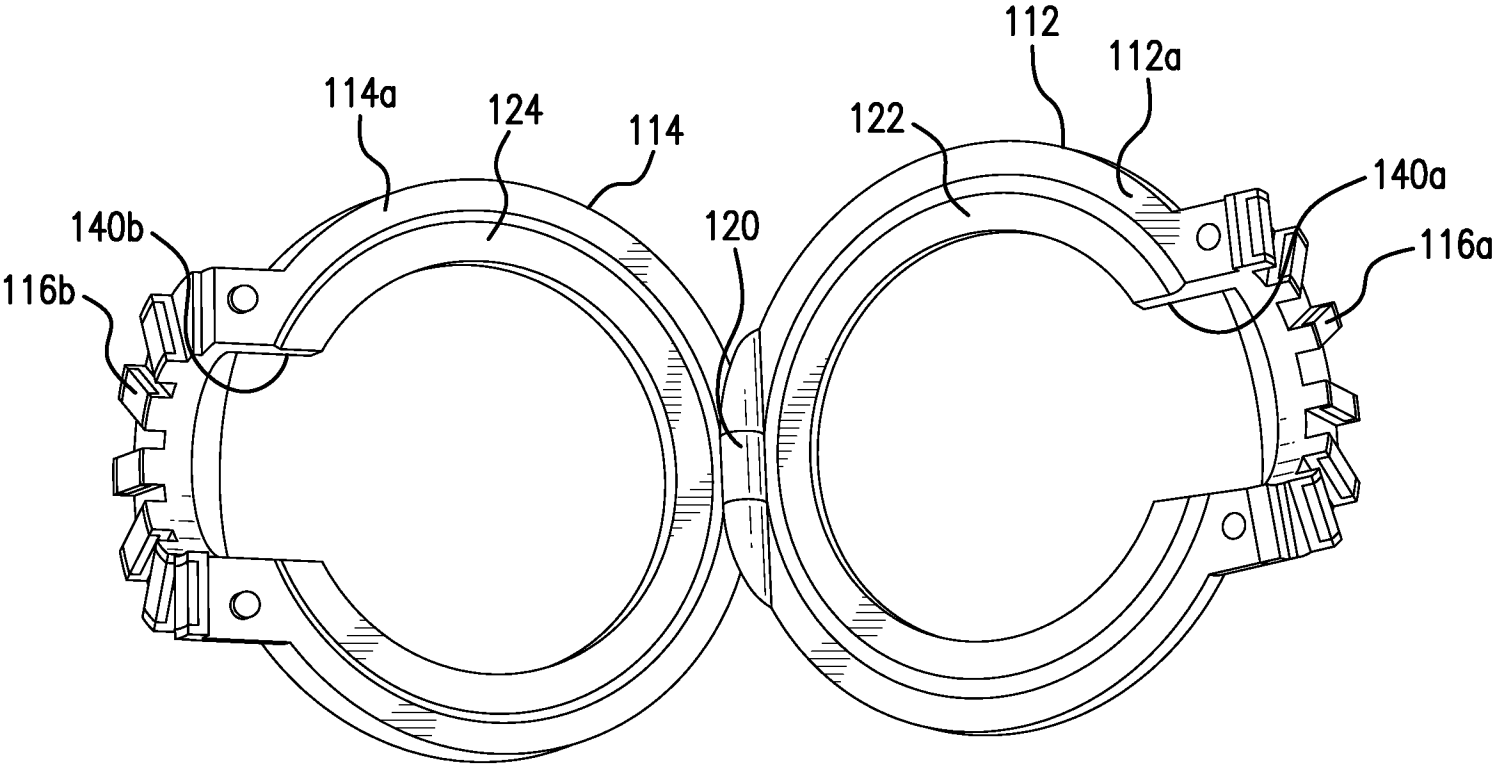
FIG. 2 is an illustration of the outer ring in an open configuration according to an exemplary embodiment of the present disclosure.

FIG. 2 is an illustration of the outer ring 110 in an open configuration according to an exemplary embodiment of the present disclosure. The first side 112 and second side 114 can be mirror images of each other that make up the outer ring 110. A hinge 120 can be provided between the first side 112 and the second side 114 allowing the outer ring 110 to open. In some exemplary embodiments, the hinge 120 can be provided along a bottom portion of the outer ring 110. The first side 112 can have a first top portion 116*a* and the second side can have a second top portion 116*b*. The top portion 116 can be comprised of the first top portion 116*a* and the second top portion 116*b*. When the outer ring 110 is closed, the top portion 116 can appear as a single unitary top part of the ring assembly, as shown in FIG. 1.

In some exemplary embodiments, a cutout or groove 122 can be provided within an inner portion 112*a* of the first side 112, and a cutout or groove 124 can be provided within an inner portion 114*a* of the second side 114. The grooves 122 and 124 can be curved and continuous, and can conform to the shape of the first side 112 and second side 114, respectively. A notch 140*a* can be provided on the first side 112, and a notch 140*b* can be provided on the second side 114. The notches 140*a* and 140*b* can provide for the opening 118 and top portion 116 to be raised based on the length of the notches.

Figure 3:
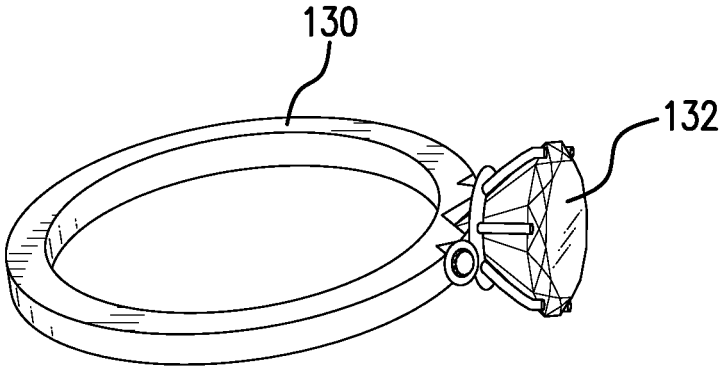
FIG. 3 is an illustration of an inner ring according to an exemplary embodiment of the present disclosure.

FIG. 3 is an illustration of an inner ring 130 according to an exemplary embodiment of the present disclosure. The inner ring 130 can be circular, oval or can be of other geometries, shapes and designs. The inner ring 130 can have an ornament 132 on a top portion, such as but not limited to a solitaire shape. Various other stones, jewels or designs can be provided on a top portion of the inner ring 130 and are not limited to any particular stone, jewel or design.

Figure 4:
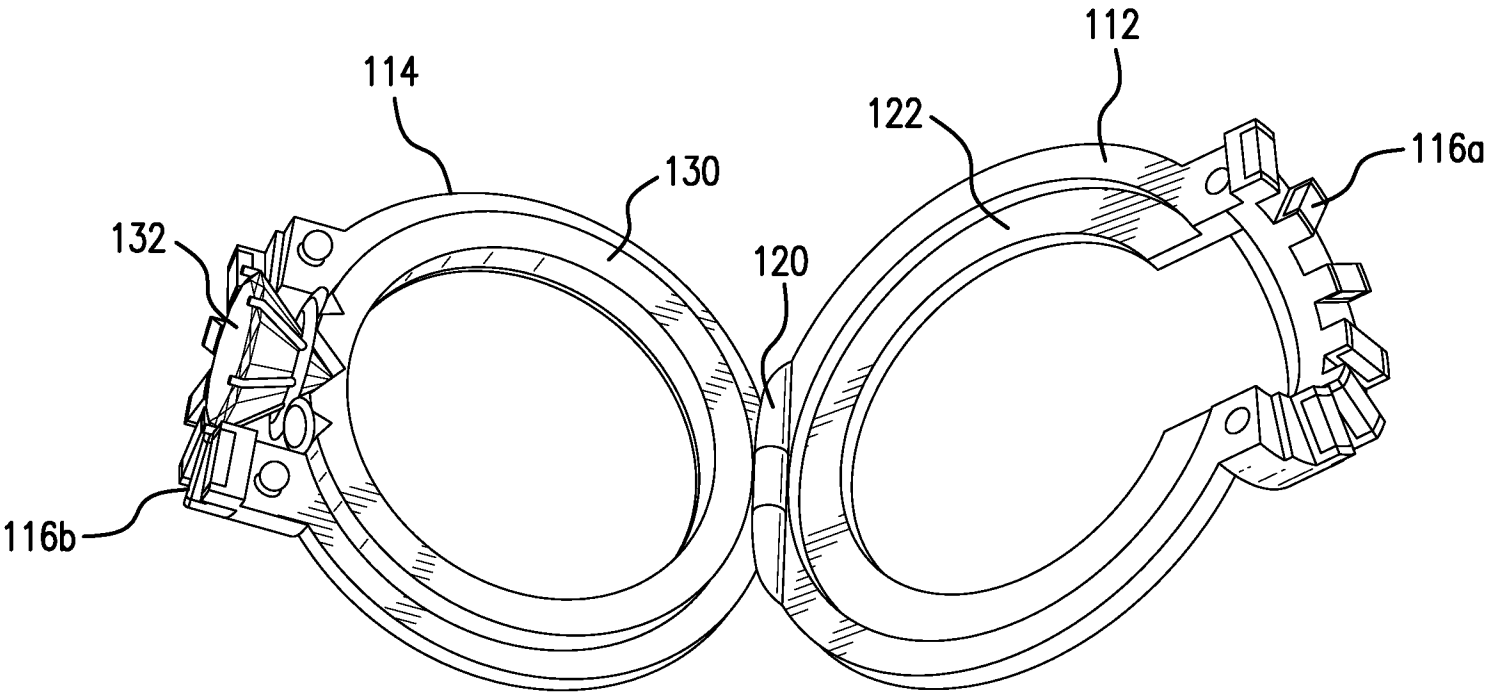
FIG. 4 is an illustration of the inner ring placed within the outer ring according to an exemplary embodiment of the present disclosure.

FIG. 4 is an illustration of the inner ring 130 placed within the outer ring 110 according to an exemplary embodiment of the present disclosure. The inner ring 130 can be placed in the outer ring 110 by, e.g., placing the band of the inner ring 130 within the groove 124 of the second side 114 (or by placing the band of the inner ring 130 within the groove 122 of the first side 112). The inner ring 130 can be of a geometry and a shape so that it fits within the grooves of the outer ring 110. The ornament 132 of the inner ring 130 can project out of the opening 118 of the outer ring 110.

Figure 5:
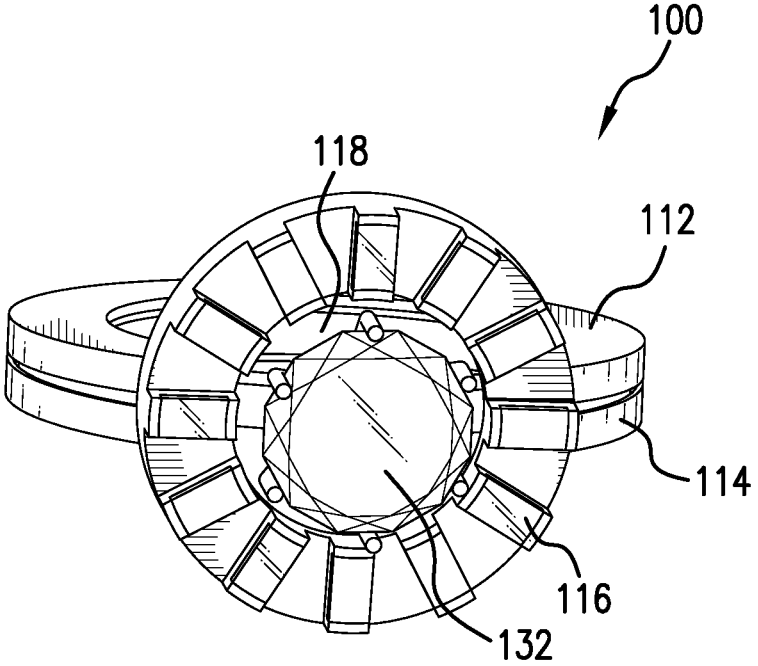
FIG. 5 is an illustration of a ring assembly according to an exemplary embodiment of the present disclosure.

FIG. 5 is an illustration of a ring assembly 100 according to an exemplary embodiment of the present disclosure. The first side 112 and second side 114 of the outer ring 114 can be closed using the hinge 120 to seal and hold the inner ring 130 within the grooves 122, 124 of the first side 112 and the second side 114, respectively. The hinge 120 can be of a sufficient strength to hold the first side 112 and second side 114 together without coming apart unless a user separates the two sides. In some exemplary embodiments, a lock or clip can be provided to hold the first side 112 and the second side 114 together. In some exemplary embodiments, the grooves 122, 124 are not visible when the outer ring 110 is in a closed configuration as shown in FIG. 5. The ornament 132 of the inner ring 130 can project out of the opening 118 of the top portion 116. The top portion 116 can have a design that surrounds the outer periphery of the ornament 132.

Various other considerations can also be addressed in the exemplary applications described according to the exemplary embodiments of the present disclosure. For example, various materials may be used to construct the inner and outer rings, such as but not limited to metal, plastic, paper or combinations thereof. Various designs, shapes, sizes and styles can be provided and used for the inner and outer rings, and the parts thereof, as described above.

The exemplary embodiments of the present disclosure can allow for several advantages. The outer ring and the inner ring can both be worn separately, and can be worn together for various combinations and looks of the ring assembly of the present disclosure. The inner ring 130 can be used with various outer rings that the inner ring 130 can fit within, and the outer ring 110 can be used with various inner rings that can fit within the outer ring 110. For example, various inner rings having various stones or jewels set on a top portion can be used with a single outer ring 110. Also, various outer rings having various designs on a top portion can be used with a single inner ring that fits within the outer rings. This can provide for a variety of different looks a user may want.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure.

What is claimed is:

1. A ring assembly, comprising:

an inner ring having a top portion including a jewel;

an outer ring comprising a groove within an inner portion of the outer ring configured to fit the inner ring, the outer ring having a top portion that is perpendicular to a lower portion of the outer ring, wherein the top portion includes a plurality of ridges that extend upwardly from the top portion that together form a circular opening when the outer ring is in a closed configuration through which the jewel protrudes; and a mechanism provided on the outer ring allowing the outer ring to be opened to place the inner ring within the outer ring.

2. The ring assembly of claim 1, wherein the mechanism comprises a hinge mechanism.

3. The ring assembly of claim 1, wherein the groove is not visible when the outer ring is in a closed configuration.

4. The ring assembly of claim 1, wherein the outer ring comprises:

a first side and a second side, wherein the mechanism holds the first side and the second side together and allows the outer ring to be in an open and closed configuration; and the groove comprises a first groove on the first side and a second groove on the second side that fits the inner ring within the outer ring.

5. The ring assembly of claim 1, further comprising:

a first support on a first side of the jewel on the inner ring; and a second support on a second side opposite the first side on the inner ring, wherein the first and second support are provided between the jewel and the top portion when the inner ring is placed within the outer ring.

6. The ring assembly of claim 5, wherein the groove of the outer ring terminates at a notch that forms the circular opening.

7. The ring assembly of claim 6, wherein the first and second supports are provided within the notch.

8. The ring assembly of claim 6, further comprising:

a design on the top portion of the outer ring that surrounds the jewel on the top portion of the inner ring when the outer ring is in a closed configuration.

9. The ring assembly of claim 1, wherein the inner and outer rings are of a circular shape.

10. An outer ring, comprising:

a first side having a first groove on an inner portion of the first side;

a second side having a second groove on an inner portion of the second side;

a first top portion perpendicular to a lower portion of the first side, where the first top portion includes a plurality of ridges that extend upwardly from the first top portion;

a second top portion perpendicular to a lower portion of the second side, where the second top portion includes a plurality of ridges that extend upwardly from the second top portion; and a hinge mechanism joining the first side and the second side that allows the first and second sides to be in an open configuration where the first and second grooves are visible and a closed configuration where the first and second grooves are not visible;

wherein the grooves are adjacent each other in the closed configuration and configured to allow a ring to be held within the grooves; and wherein the plurality of ridges on the first top portion and the second top portion together form a circular opening in the closed configuration.

11. The outer ring of claim 10, further comprising:

an opening formed by the first top portion and the second top portion when the first and second sides are in a closed configuration.

12. The outer ring of claim 11, further comprising:

a design on the first top portion and the second top portion that surrounds the opening when the first and second sides are in a closed configuration.

13. The outer ring of claim 11, wherein the hinge is provided on a bottom portion of the first and second sides.

* * * * *